United States Patent [19]

Salminen

[11] 4,193,366

[45] Mar. 18, 1980

[54] SAILING BOAT AND METHOD OF OPERATING THE SAME

[76] Inventor: Reijo K. Salminen, 1842 Academy Rd., Bellingham, Wash. 98225

[21] Appl. No.: 890,363

[22] Filed: Mar. 27, 1978

[51] Int. Cl.[2] ..... B63B 35/00; B63H 9/00

[52] U.S. Cl. ..... 114/39; 114/140; 114/56; 114/274; 114/280

[58] Field of Search ..... 114/56, 39, 61, 126, 114/127, 140, 141, 143, 142, 121, 122, 271, 274, 275, 280, 281, 282, 284, 285

[56] References Cited

U.S. PATENT DOCUMENTS

| | | | |
|---|---|---|---|
| 1,356,300 | 10/1920 | McIntire . | |
| 1,499,900 | 7/1924 | Zukcker . | |
| 2,703,063 | 3/1955 | Gilruth | 114/39 |
| 2,858,788 | 11/1958 | Lyman | 114/126 |
| 3237582 | 3/1966 | Sturgeon . | |
| 3,373,710 | 3/1968 | Steinberg . | |
| 3,377,975 | 4/1968 | Field . | |
| 3,505,468 | 4/1970 | Gorman . | |
| 3,800,724 | 4/1974 | Tracey . | |
| 3,842,777 | 10/1974 | Larsh . | |
| 3,949,695 | 4/1976 | Pless . | |
| 4,058,076 | 11/1977 | Danahy . | |

*Primary Examiner*—Stephen G. Kunin
*Assistant Examiner*—D. W. Keen

[57] ABSTRACT

A sailboat having a hull, a sail assembly and a keel. The keel is shaped as a longitudinally and horizontally extending hydrofoil which developes a vertically downward force. When the boat is traveling in a heeled position, the keel member exerts a downwardly and outwardly directed keel force having a lateral force component to substantially counteract an opposite lateral aerodynamic force component exerted by wind against the sail assembly, thus diminishing the yaw angle in the travel of the boat. Further, the keel force acts through the center of gravity of the boat to produce a righting moment which tends to counteract the capsizing moment developed by the force of the wind against the sail assembly.

17 Claims, 19 Drawing Figures

FIG. 8
FIG. 10
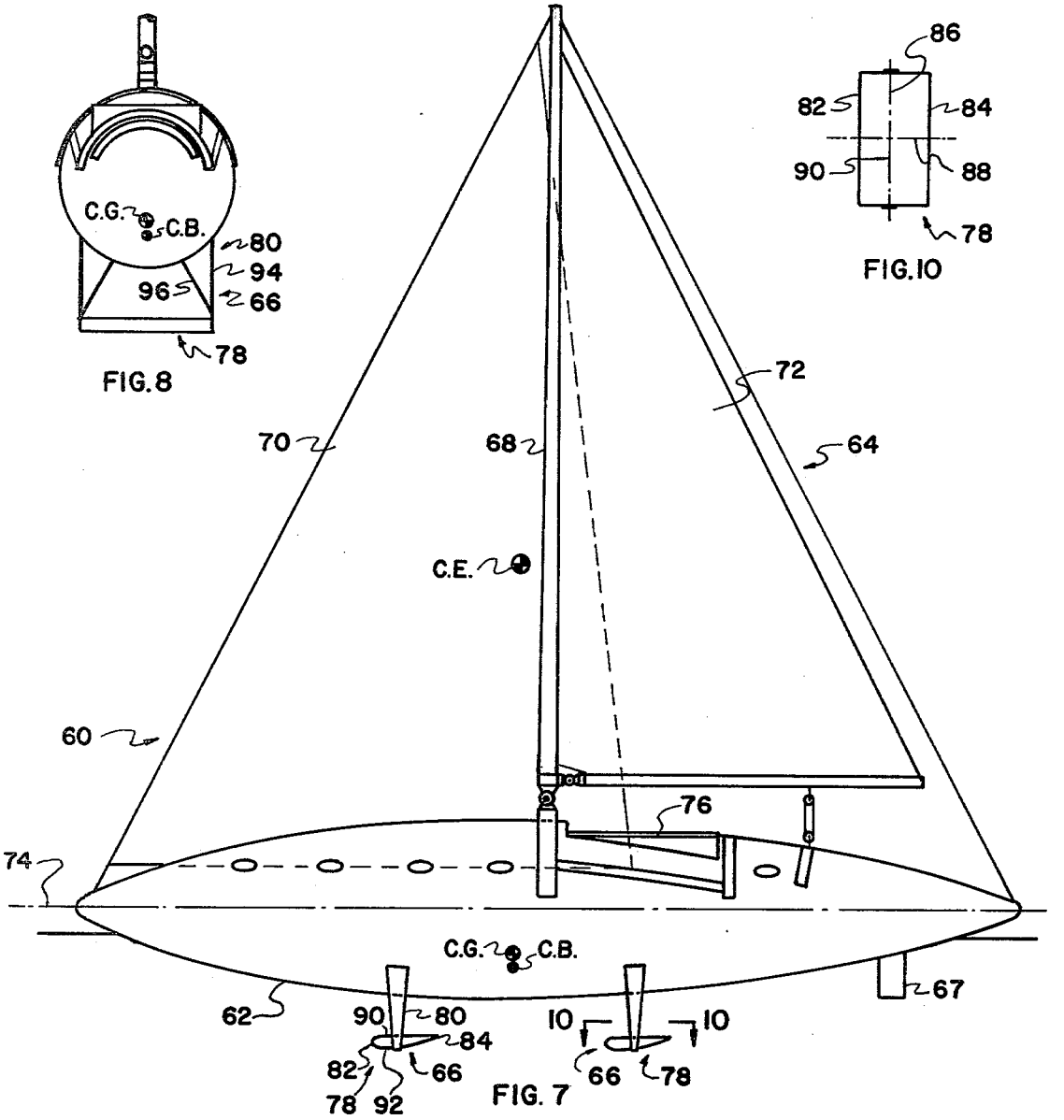
FIG. 7
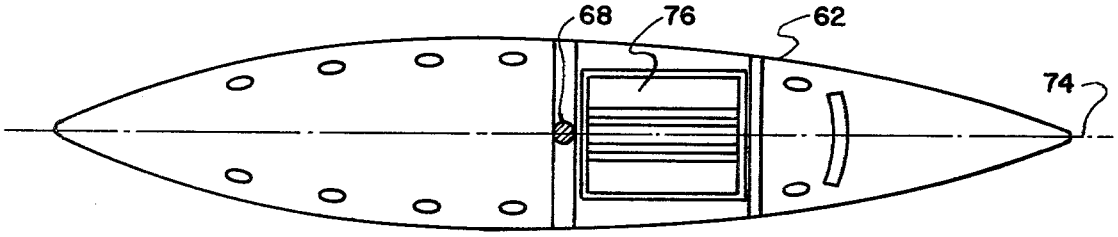
FIG. 9

SAILING BOAT AND METHOD OF OPERATING THE SAME

BACKGROUND OF THE INVENTION (a) Field of the Invention

The present invention relates to sailing boats, and more particularly to an improved keel design for a sailing boat, and also to a method of operating a sail boat.

(b) Brief Description of the Prior Art

A type of conventional sailing boat which has been in existence for many centuries is one which comprises a hull, a sail assembly, and a keel structure. While the function of the keel structure will be discussed in more detail later, it can be stated generally that the main function of the keel is to act as a vertically oriented hydrofoil which resists lateral movement of the boat so that the boat can travel on an angled course in an upwind direction. Also, quite often the keel is weighted so as to add ballast and lower the center of gravity of the boat to enhance the stability of the boat. While there have been many refinements in such sailing boats, this basic design of sailing boats has for many centuries been the one most commonly used.

Also known in the prior art are other applications of hydrofoils in boats. One of the best known applications of hydrofoils is to lift the hull of the boat out of the water so that the hull is being supported entirely by the lifting force provided by the hydrofoils traveling through the water. One of the main advantages of such a design is the relatively high speed with which the boat can travel over the water.

There have been other proposed applications of hydrofoils in boats, mainly to provide adequate stability. One such application is shown in U.S. Pat. No. 1,499,900, Zukucker, where a plurality of fins are provided on two sides of a power boat. These fins may be adjusted both upwardly and downwardly to improve the stability of the boat. In two other patents, U.S. Pat. Nos. 3,377,975, Field, and 3,842,777, Larsh, laterally extending fins are provided on opposite sides of a ship to alleviate any roll condition of the ship.

There have also been various attempts in the prior art to stabilize sailing vessels by the use of hydrofoils. For example, in U.S. Pat. No. 1,356,300, McIntire, there are a pair of "stabilizing planes" mounted at the outer end of outrigger arms. Each stabilizing plane is slanted at a downward and inward inclination. When the vessel is traveling at an angle to the wind so that the wind is exerting a lateral force on the boat to cause it to yaw, the two stabilizing planes not only provide a resisting lateral force, but also exert moments which tend to keep the vessel in an upright position.

A quite similar arrangement is shown in U.S. Pat. No. 3,949,695, Pless, where there are a pair of hydrofoil members mounted at the outer ends of outrigger arms on opposite sides of the hull. These hydrofoils function to stabilize the vessel in generally the same manner as the apparatus shown in the McIntire patent. In addition, the hydrofoils are rotatedly mounted in such a manner that when the vessel is yawing, the two hydrofoils automatically change their angle of attack to augment the lift and thus contribute to the stability of the craft to a greater extent.

U.S. Pat. No. 4,058,076, Danahy, shows a hydrofoil device which functions generally in the same manner as those in the McIntire patent and the Pless patent noted above. However, in the Danahy patent, the hydrofoil members extend from opposite sides of the hull downwardly to a central location beneath the hull.

There have been other attempts in the prior art to utilize hydrofoils in combination with sailing vessels in such a manner as to lift the hull of the vessel totally out of the water. One such device is shown in U.S. Pat. No. 3,373,710, Steinberg, where there is a hydrfoil positioned beneath the boat, this hydrofoil being provided with a set of "ailerons". These ailerons are intended to function in somewhat the same manner as ailerons on a conventional aircraft to maintain the sailboat in an upright position. A somewhat more complex arrangement is shown in U.S. Pat. No. 3,800,724, Tracy. This shows a "winged sailing craft" which has a vertical airfoil to provide a force for forward travel, and a horizontal airfoil to provide stability. In addition, there are provided upper and lower hydrofoils. The upper hydrofoil serves to lift the vessel out of the water at lower speeds, and the lower hydrofoil is arranged to travel through the water to provide either positive or negative lifting forces as required.

U.S. Pat. No. 3,505,968, Gorman, shows a hydrofoil which is mounted below a hull of a sailboat in a manner to function generally as a conventional keel. The hydrodynamic shape of the hydrofoil is not symmetrical so as to improve its "lift" characteristics, and it's mounted for rotation about a horizontal longitudinal axis so that its lifting force can be exerted laterally to one side or the other. As a third alternate arrangement, the hydrofoil is turned so as to provide an upward lifting force when the boat is running with the wind.

Finally, U.S. Pat. No. 3,237,582, Sturgeon et al, illustrates a particular form of a disk hydrofoil which is contended to overcome some of the problems of "skin friction".

SUMMARY OF THE INVENTION

In the present invention, there is a sailboat comprising a hull having front and rear ends, a longitudinal axis, a transverse horizontal axis and a vertical axis A sail assembly is mounted to the hull and arranged to be positioned relative to wind which is blowing at an angle to the longitudinal axis of the hull so that the sail develops an aerodynamic force within a predetermined force range. The aerodynamic force has a lateral aerodynamic force component and a forward aerodynamic force component.

There is a keel member which is of particular signficance in the present invention. The keel member is mounted beneath the hull, and has a cordwise axis generally aligned with the longitudinal axis and a spanwise axis generally aligned with the transverse horizontal axis. The The keel member is hydrodynamically contoured so that with the boat moving forwardly through water, the heel member produces a downward hydrodynamic force generally aligned with the vertical axis. The keel member is positioned, sized and contoured relative to the sail assembly so that with the boat in a heeled position, the keel member develops a downwardly and laterally directed keel force with both vertical and lateral keel force components.

The keel force is of a magnitude that the lateral keel force component substantially counteracts the lateral aerodynamic force component. The effect of this is that with the boat traveling with its longitudinal axis at an angle to the wind, the keel member is able to generate its hydrodynamic force simply by virtue of forward movement of the boat, without necessity of the boat traveling at a yaw angle. Thus, the hydrodynamic lateral force component is able to substantially counteract the lateral aerodynamic force component in a manner to substantially diminish yaw angle in the forward travel of the boat.

In the preferred embodiment, the keel member is so positioned that the keel force which is developed by the keel member is generally aligned with the center of gravity of the boat. Thus with the boat in a heeled position, the keel force develops a righting moment which tends to counteract at least partially a capsizing moment developed by the lateral aerodynamic force component. In one configuration, the keel member comprises at least one main hydrofoil member positioned beneath the hull and spaced downwardly therefrom at a general location directly beneath the center of gravity. In another configuration, the keel member comprises a plurality of hydrofoil members positioned beneath the hull and spaced downwardly therefrom, with these hydrofoil members being spaced longitudinally from one another along the hull.

In another configuration, the keel member is provided with adjustable mounting means to permit angle of attack of the keel member to be changed to generate greater or less downward keel force.

The hull has an upper portion and a lower portion adapted to engage water upon which the boat is floating. In the preferred configuration, at least the lower hull portion has a convexly curved generally circular transverse cross-sectional configuration, with the hull tapering to a narrower cross-sectional configuration in both a forward and rear direction from a center portion of the hull. The hydrofoil member is spaced downwardly from the hull so that water passes between the hull and the keel member.

In the method of the present invention, a sail boat is provided having a keel member such as that described above. This keel member is then utilized to produce a downward hydrodynamic force generally aligned with the vertical axis, with the keel member being positioned, sized and contoured relative to the sail assembly, so that with the boat in a heeled position, the keel member develops a downwardly and laterally directed keel force with both vertical and lateral keel force components of such a magnitude that the lateral keel force component substantially counteracts the lateral aerodynamic force component. Desirably, the keel is so positioned that the hydrodynamic force is aligned with the center of gravity of the boat. In accordance with one embodiment, the keel member is adjusted angularly in a manner to change its angle of attack to generate a keel force of a proper magnitude to properly counteract the aerodynamic force component.

BRIEF DESCRIPTION OF THE DRAWING

FIG. 7 is a side elevational view of a sailboat incorporating the teachings of the present invention;

FIG. 8 is a rear elevational view of the boat of FIG. 7;

FIG. 9 is a top plan view of the sailboat of FIG. 7, taken from a view immediately above the base of the mast;

FIG. 10 is a sectional view taken along line 10—10 of FIG. 7, in plan view of one of the hydrofoil members of the keel of the present invention;

DESCRIPTION OF THE PREFERRED EMBODIMENT

It is believed that a clearer understanding of the present invention will be obtained by first describing the main operating characteristics of a sailboat having a conventional keel arrangement, and then describing the present invention and its operating characteristics.

I. Consideration of the Prior Art

Figure 1:
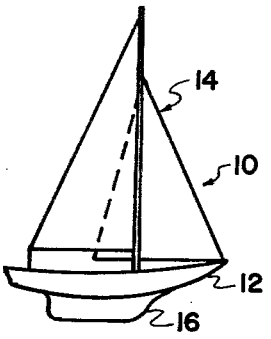
FIG. 1 (PRIOR ART)
FIG. 1 is a side elevational view of a typical prior art sailing vessel.

A typical prior art boat is indicated at "10", and it has a conventional keel arrangement indicated somewhat schematically in FIG. 1. It can be seen that the boat 10 has a hull 12, a sail assembly 14, and a keel 16. The keel 16 is longitudinally and vertically alligned and extends downwardly from the longitudinal centerline of the hull 12.

(1) General Operating Characteristics of a Sailboat with a Conventional Keel

Figure 2:
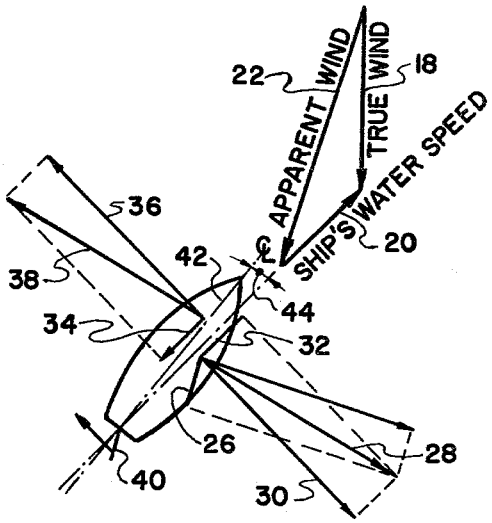
FIG. 2 (PRIOR ART)
FIG. 2 is a semi-schematic top plan view illustrating the various forces exerted on a typical prior art sailing vessel when the vessel is close hulled and traveling into the wind at a 45° angle.
Figure 3:
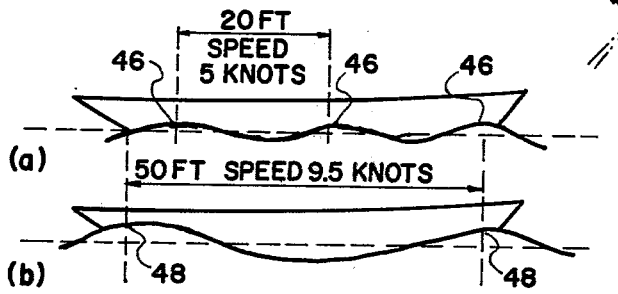
FIGS. 3(*a*) and 3(*b*) are semi-schematic views of a typical sailing vessel and illustrating the wave pattern developed at various speeds.

For purposes of analysis, in FIG. 2 the boat 10 is shown in a plan view in a position where boat 10 is "close hauled" and traveling at an angle in an upwind direction, with the true direction of the wind at about 45° off the bow. As illustrated vectorially in FIG. 2, the velocity of the true wind is represented by vector 18, the boat's velocity is illustrated by the vector 20, and resultant vector 22 represents the apparent velocity of the wind relative to the boat 10.

The wind acts against the sail 14 to produce two force components, one parallel to the apparent wind vector 22 and one perpendicular thereto. The perpendicular force component is represented by vector 24 and indicates the "lift force" generated by the wind acting against the sail. The parallel force component represented by vector 26 is in effect the air drag against the boat. These two force components 24 and 26 produce a resultant force, represented by vector 28. This resultant force 28 can in turn be divided into two vectorial components, relative to the ship's line of travel which is indicated by vector 20. One vector component 30, perpendicular to the line of travel is the resultant lateral thrust force of the wind and the second vector component 32 (parallel to the ship's line of travel) represents the driving force which moves the boat forward.

With the boat 10 traveling in a straight line at a constant speed (i.e. the boat being in a condition of equilibrium), the two wind force components 30 and 32 are balanced mainly by two other force components provided by the action of the water against the boat. One such force component is represented by vector 34 and is the effect of water drag against the hull 12 and keel 16 of the boat 10, this drag force being indicated as exerted parallel to the boat's path of travel. The other force component 36 is directed perpendicular to the boat's line of travel and represents the lateral force exerted by the water against the keel 16 and hull 12 to counteract the wind force component 30 and keep the boat on its path of travel. The resultant of these two force components 34 and 36 is indicated by a vector 38. In the particular condition shown herein, the point of application of the vector force 38 (representing the force of the water against the boat 10) is forward of the point of application of the wind vector 28. Accordingly, this results in a turning moment exerted on the boat 10, which turning moment is counteracted by a rudder 40 mounted on the aft portion of the hull 12.

Further, it will be noted that the longitudinal centerline of the boat 10 (indicated at 42 in FIG. 2) makes an angle with the vector 20 representing the path of travel of the boat 10. The angle made by the centerline 42 with the travel line 20 is known as the "yaw angle" indicated at 44.

(2) Water Resistance on a Sailboat with Conventional Keel Arrangement

The resistance provided by the water to the motion of a boat under sail can be considered as being made up of four main components, namely:

a. frictional resistance
b. wave-making resistance
c. eddy-making resistance
d. induced drag These will be considered in order.

a. Frictional resistance

Frictional resistance can be considered as skin friction or surface friction, and it depends upon four factors, namely, (1) area of surface (2) length of surface (3) roughness of surface, and (4) speed. In general the frictional resistance increases proportionally with the total area of surface. On the other hand, greater length of surface generally decreases surface friction, so that a longer boat experiences less frictional resistance per square foot of wetted surface than one shorter. Obviously, if the surface is rougher the friction increases, and also increase of speed increases the surface friction.

b. Wave-Making Resistance

This is the resistence encountered by the pushing water aside as the boat moves through the water, which results in a series of wave crests along the length of the hull. At low speeds, the crests of the waves will be closer together and hardly visible. As the speed of the boat rises, the waves deepen, and the crests move further apart, until, at the boat's maximum speed, the boat is carried on a single wave with a crest at the bow and another slightly aft of the stern. This is illustrated in FIGS. *3a* and *3b*. In FIG. *3a*, the boat 10 is shown traveling at about two thirds of its maximum speed and it can be seen that there are three wave crests 46 along the length of the hull 12. In FIG. *3b*, the speed of the boat has increased to a maximum, and the crests have moved further apart so that there is a single crest 48 at the front of the hull 12 and a second single crest 48 at the rear of the hull 12.

At this point, it is believed to be profitable to consider the relationship of the two factors noted above, namely the frictional resistance and the wave making resistance and how these change relative to the speed of the boat. This is in turn dependent upon the boat's "speed length ratio", which is defined as the speed of the boat measured in knots divided by the square root of the waterline length of the boat, measured in feet. Up to a speed length ratio of between 0.6 to 0.8, the total resistance against the boat's travel increases approximately as the square of the speed. Above that speed length ratio, the resistance increases more rapidly with speed. Also, the proportion of the two main sources of resistance (i.e. frictional resistance and wave making resistance) changes drastically. For example, in a given instance at a speed length ratio of 0.8, the frictional resistance is approximately three times the wave making resistance. As the speed length ratio increases to 1.0 the frictional resistance is slightly less than the wave making resistance. By the time the speed length ratio has reached 1.3, the wave making resistance is nearly three times that of the frictional resistance.

c. Eddy-Making Resistance

While eddy-making is not a big consideration in power craft it is more significant in sailing boats. One of the reasons for this is that a sailing boat spends much of her time at a yaw angle which tends more to generate following eddy currents.

d. Induced Drag

Induced drag is not a separated component of resistance to the travel of the boat through the water, but is defined as the increase in resistance due to heel and yaw angle of the boat. First, with regard to heel angle, if a boat is traveling in an upright position with its path of travel parallel to its longitudinal centerline, and if the boat continues travel parallel to its longitudinal centerline but is heeled over 5° or more, then with most boat designs, there will be a certain increase in total resistance, possibly on the order of 10% to 20%. However, when the boat 10 with the conventional arrangement of the keel 16 is heeled over, it is also generally traveling at a yaw angle. Experimental work indicates that for some boat designs a yaw angle of 2° can increase total resistance as much as 15% over what it should be with no yaw angle, and a yaw angle of 4° can increase the resistance as much as 45%. These increases are in addition to the increased resistance resulting from the ship being heeled over.

(3) Prior Art Keel of Conventional Design

The keel has four purposes: (a) it effects the static stability of the boat by providing ballast at a lower location; (b) it produces most of the hydrofoil action needed to resist the lateral component of the wind force (c) it influences the qualities of the steering and handling of the boat and, (d) it supports the boat when on the ground and when being transported over land. These subjects will be considered in order.

a. Static Stability

A boat is generally designed so that the center of gravity (C.G.) is at the longitudinal centerline of the boat. When the boat is in an upright position, the center of buoyancy (C.B.) is also at the longitudinal center line of the boat. However, when the boat heels to one side or the other, the center of buoyancy (C.B.) moves laterally in the direction of heel, while the center of gravity (C.G.), being fixed by the construction and the ballast weight of the boat, remains where it was on the centerline. The buoyant force of the water acting at the center of buoyancy coacts with the gravitational forces at the center of gravity to provide a force couple which tends to bring the boat back to its upright position.

Figure 4:
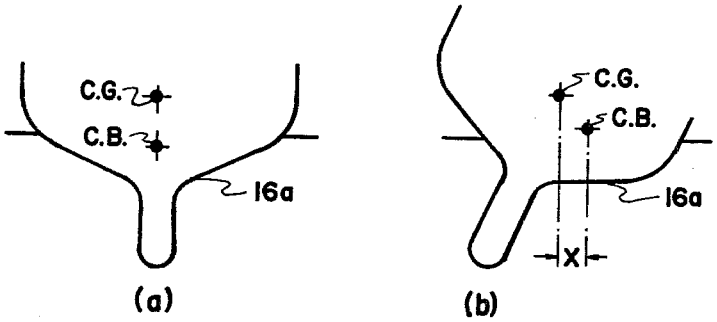
FIG. 4 (PRIOR ART)
FIGS. 4(*a*) and 4(*b*) illustrate semi-schematically a prior art sailing vessel in transverse section, with the vessel having a relatively high center of gravity, and showing the vessel in an upright and a heeled position to illustrate the effect of the righting moment applied to the vessel.

In general, it can be stated that the static stability of a boat is increased by lowering its center of gravity. With reference to FIGS. 4*a* and 4*b*, there is shown in cross section a hull 16*a*, having a center of gravity (C.G.) located moderately above the center of buoyancy (C.B.) In FIG. 4*b*, this same hull 16*a* is shown in a heeled position. It can be seen that the center of buoyancy has shifted in the direction of heel so that it is located moderately outside the center of gravity by a distance indicated as "x" in FIG. 4*b*.

Figure 5:
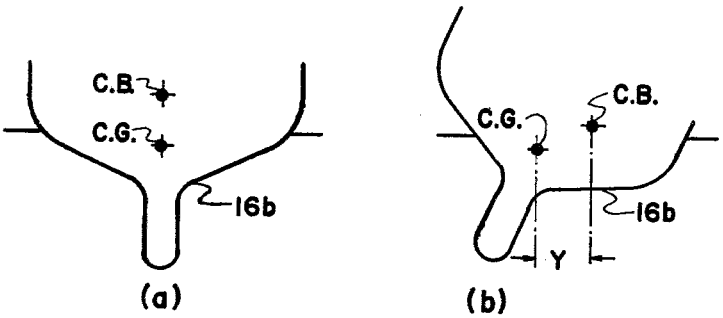
FIG. 5 (PRIOR ART)
FIGS. 5(*a*) and 5(*b*) are views similar to FIGS. 4(*a*) and 4(*b*), but showing a vessel with a low center of gravity and the effect of this on the righting moment of the vessel in a heeled position.

In FIGS. 5*a* and 5*b*, there is shown a second hull 16*b* having a somewhat deeper keel and a lower center of gravity (C.G.) which in this case is positioned below the center of buoyancy (C.B.). In FIG. 5B, this second hull 16*b* is shown in a heeled position where the center of buoyancy has shifted laterally. It can be seen that because of the lower center of gravity of the hull 16*b*, the lateral distance between the C.G. and the C.B. (indicated at "y") of hull 16*b* is greater that that shown in FIG. 4*b*. Thus, the force couple which tends to restore the hull 16*b* to its upright position is greater than that for the hull 16*a*, for a boat of a given displacement.

It is for this reason that the keel 16 of the boat 10 is weighted to provide ballast at the most desirable location to lower the total center of gravity of the boat 10. However, as will become apparent from the discussion in the next section, while this may improve static stability of the boat 10, it may well have an adverse effect with regard to the dynamic stability.

b. Keel Producing a Hydrofoil Action to Resist the Lateral Component of the Wind Force When the boat is sailing with the wind anywhere but dead astern, there is a component of wind strength acting at right angles to the boat tending to produce broadside drift. It is the function of the keel 16 to resist this. The side or drift force is strongest under close hauled conditions (such as shown in FIG. 2) where it may be about three times the driving force. That is to say, with reference to FIG. 2, the lateral wind component 30 can be about three times the driving force component, represented by the vector 32.

When the boat is running before the wind, so that there is no lateral component of wind force, there is no yaw angle, and thus the keel develops no lateral force. However, when a lateral wind force is developed, the boat 10 begins to travel at a yaw angle so that the keel 16 likewise is traveling at an angle to the water, and the keel develops a lift component which opposes the lateral wind component. The efficiency of a keel lies to a large extent in its ability to produce the necessary "lift" or resistance to broadside drift, at a reasonably small angle of yaw. The chief factors governing this are firstly the "aspect ratio" of the keel and secondly by the fore and aft sectional shape of the keel.

The "aspect ratio" can be defined as the ratio of the effective length of the keel to its depth. A deep, short keel has a high aspect ratio and thus generates a greater lateral force relative to the drag created by the keel. However, since there are limitations as to the allowable draught of a boat, keels are generally made with a lower aspect ratio.

Figure 6:
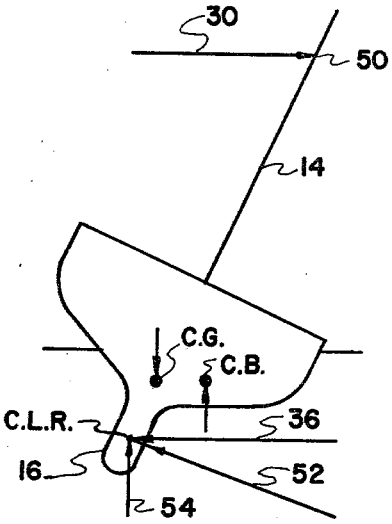
FIG. 6 (PRIOR ART)
FIG. 6 is a transverse sectional view of a typical prior art vessel in a heeled position, illustrating the major force components exerted on the vessel.

To illustrate the manner in which the lateral force is exerted by the keel 16, reference is made to FIG. 6 which shows the boat 10 of FIG. 1 schematically from a rear view heeled over approximately 30°.

To illustrate the lateral force which is exerted by the keel 16, reference is made to FIG. 6 which shows the boat 10 shown in FIG. 1 schematically from a rear view heeled over approximately 30+. It can be seen that the lateral force component 30 of the wind is exerted against the sail assembly 14 at an effective point 50 which is considerably above the center of buoyancy (C.B.). The force exerted by the keel 16 against the water is generally perpendicular to the plane of the keel, this force being indicated at 52. This force 52 has a horizontal force component, which is the aforementioned force component 36, and also a vertical force component 54.

The point of application of the force 52 is called the C.L. R. (center of lateral resistance). As indicated earlier herein, with the boat 10 traveling in a straight line at a constant speed (i.e. the boat being in a condition of equilibrium), the force component 36 will substantially balance the force component 30. (Since the rudder 40 also provides a lateral force component, it also will effect the balance between the force components 30 and 36).

While the force vector 52 produces the necessary force component 36 to resist broadside drift, it also acts about the center of buoyancy (C.B.) to tend to cause the boat 10 to heel over at even a greater angle. Thus, the force 52 exerted by the keel 16 does not counteract the force of the wind 30, with regard to producing a heeling moment, but rather reinforces the wind force 30 causing the boat 10 to heel over to detract from the stability of the boat 10. As indicated earlier, these force vectors 30 and 52 are resisted by the force couple exerted at the C.G. and C.B. by the force of gravity and the buoyant forces of the water, respectively.

As indicated earlier herein, the stability of the boat 10 can be enhanced by lowering its center of gravity. One way of lowering the center of gravity is by weighting the keel, and also making the keel deeper. However, from an examination of FIG. 6 it becomes apparent that as the keel is made deeper, the point of application of the force 52 against the keel also becomes lower, thus increasing the length of the lever arm about which the force 52 acts relative to the C.B. This would tend to make the boat 10 heel over yet further, and thus have a tendency to counteract the benefit obtained by deepening the keel 16.

c. The Keel Affecting the Steering and Handling of the Boat

In FIG. 2, the lateral wind force component 30 is shown exerted at a location rearwardly of the point at which the lateral force component 36 is exerted. The reason for this is that when the boat is traveling at a relatively large yaw angle, quite often the C.L.R. moves to a further forward location, because of the combined effects of the hull and keel moving through the water on a slant. As indicated previously, this is counteracted by use of the rudder 40. As a general comment, it can be stated that the steering and handling qualities of the boat are generally better if the effect of the shifting of the C.L.R. can be diminished. Thus if the keel 16 can keep the yaw angle to a practical minimum, the steering and handling characteristics of the boat 10 are enhanced.

d. The Keel Supporting the Boat When On the Ground

Obviously, when the boat is out of the water and positioned on the ground or other support in an upright location, the keel 16 should be made sturdy enough to provide at least some support for the boat 10.

II. Description of the Present Invention

The boat 60 of a first embodiment of the present invention is shown in FIGS. 7 through 12. This boat 60 comprises a hull 62, a sail assembly 64, a pair of keel members 66, and a rudder 67. The arrangement of the keel members 66 is of particular significance in the present invention and will be discussed in detail later herein.

The sail assembly 64 is or may be of conventional design, and as shown herein comprises a mast 68 to which are mounted a head sail 70 and a mainsail 72. The hull 62 has a rounded, elongate configuration, and is symmetrical about its longitudinal center axis 74. The outside surface of the hull is in the shape of a surface of revolution generated by rotating a segment of a circle about its cord length. Thus at any location along the length of the hull, the hull has a circular cross sectional configuration, and the radius of curvature of the cross sectional configuration is at a maximum at the longitudinal center point of the hull 62 and diminishes in both a forward and rearward direction. In longitudinal section, the outside surface of the hull has uniform curvature along substantially its entire length. That is to say, if a plane is passed through the longitudinal center axis 74 of the hull 62, the two lines along which such a plane would intersect the surface of the hull 62 would be two identical arcs of uniform curvature. The top portion of the hull 62 is cut away at a location directly behind the mast 68 to provide for a cockpit 76 from which the boat 60 is operated.

Each keel member 66 comprises a hydrofoil member 78 and a related mounting frame 80. Each hydrofoil 78 has a leading edge 82 and a trailing edge 84, with its spanwise axis 86 being horizontally and transversely aligned, and the cordwise axis 88 being longitudinally aligned. Each hydrofoil member 78 is hydrodynamically contoured so that as the boat 60 is moving in a forward direction through water, each hydrofoil member 78 produces a resultant "lift" force in a downward direction. As shown herein, the upper surface 90 of each hydrofoil member 78 has a more planar configuration, while the lower surface 92 of each airfoil 78 is cambered in a manner to maximize the downward force generated by the hydrofoil member 78, while minimizing hydrodynamic drag. Also, each hydrofoil member is slanted moderately downward in a forward direction (e.g. typically a two to five degree angle of attack) to augment the downward lift force.

Each hydrofoil member 78 is centered laterally with respect to the longitudinal centerline 74, so that the downward hydrodynamic force generated by each hydrofoil member 78 passes through the longitudinal centerline 74 of the hull 62. Also the two hydrofoil members 78 are positioned on opposite sides of, and equally distant from the center of gravity of the boat 10 (indicated as "C.G." in FIGS. 7 and 8) so that the substantially equal hydrodynamic forces generated by the two hydrofoil members 78 produce a resultant downward force passing through the center of gravity of the boat 60.

The two hydrofoil members 78 are desirably made of a heavy material (e.g. cast iron) and are positioned below the hull to at least a moderate depth. In the particular configuration shown in FIGS. 7 and 8, each of the mounting frame 80 comprises a pair of vertical side struts 94 attached at their lower ends to the outside ends of their related hydrofoil members 78 and extending upwardly to be joined to the hull 62. There are also a pair of upwardly and inwardly extending bracing structs 96 to add rigidity to each framework 80. These struts 94 and 96 are contoured to minimize hydrodynamic drag.

Figure 11:
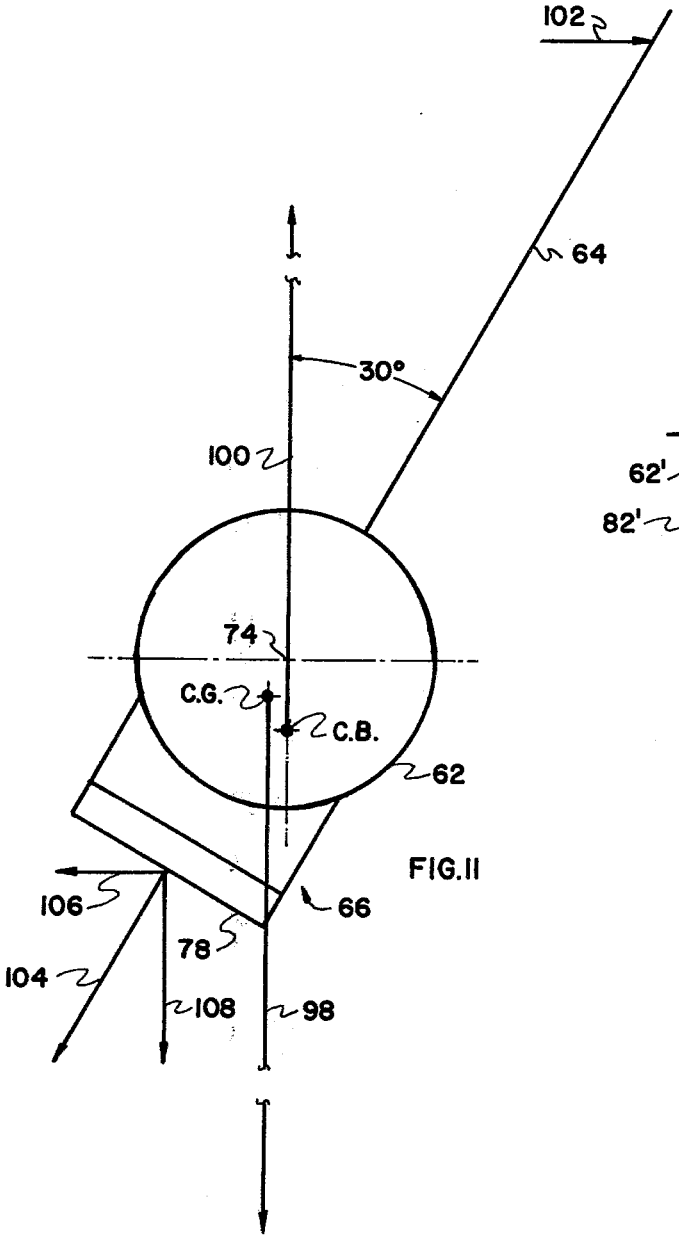
FIG. 11 is a semi-schematic transverse sectional view of the sailboat of the present invention, illustrating the various force components applied to the boat when it is heeled at 30°.

To describe the operation of the present invention, reference is made to FIG. 11, which is a cross sectional view of the boat 60 in a position where it is heeled over at about a 30° angle. Let it be assumed that the boat 60 is in a close hauled condition so as to be traveling upwind at an angle of about 45° to the true direction of the wind. In this condition, the center of buoyancy (C.B.) has shifted laterally to the right (as seen in FIG. 11) relative to the center of gravity (C.G.) so that the buoyant force of the water exerted at the C.B and the force of gravity exerted at the C.G. produce a force couple tending to bring the boat toward an upright position. The force component at the center of gravity is indicated at 98, and the force component exerted by the buoyancy of the water is indicated at 100. The force of the wind acting against the sail assembly 64 is indicated by the force vector 102, and this force vector 102 is counteracted to a large extent by the force couple 98-100. For convenience of illustration, the components 98 and 100 have not been drawn to scale.

As indicated previously, with the boat 60 traveling forwardly through the water, the two hydrofoil members 78 produce a resultant downward force passing through the longitudinal centerline 74 of the hull 62. The resultant force created by the two hydrofoil members 78 is indicated by the force vector 104, and this force vector 104 can be considered as being made up of two force components, namely a first horizontal force component 106, and a second vertically downward force component 108. The relationship of the hydrofoil members 78 to the sail assembly 64 is critical. The size, configuration and angle of attack of the hydrofoil members 78 are selected so that the magnitude of the resultant force 104 is such that the lateral force component 106 substantially balances the wind force vector 102. Thus as the force of the wind against the sail assembly 64 increases so as to tend to cause the boat 60 to heel at a greater angle, the lateral force component 106 generated by the hydrofoil member 78 increases relative to the total force vector 104 generated by the hydrofoil members 78 and thus is better able to counteract the wind force vector 102.

It is important to note that the lateral force component 106 is developed by the hydrofoil member 78 simply by the fact that the boat 60 is in a heeled position and traveling forwardly through the water. Thus, it is not necessary for the boat 60 to be traveling at a yaw angle through the water to develop the resisting force to counteract sideways drift of the boat. Thus, it is possible for the boat 60 to travel in an upwind direction with substantially no yaw angle, or at the most a relatively small yaw angle. It would even be possible under some circumstances to travel upwind at a negative yaw angle.

It is also important to note that the resultant force vector 104 generated by the hydrofoil members 78 passes through the longitudinal centerline 74 of the hull 62. Thus with the boat 60 in a heeled position so that the center of buoyancy (C.B.) has shifted laterally in the direction of heeling, the force vector 104 produces a moment about the center of buoyancy (the moment arm being equal to the distance which the center of buoyancy has shifted laterally from the center axis of the hull 62) which moment tends to counteract the tendency of the wind force vector 102 to cause the boat 60 to heel yet further over. Thus, the force vector 104 generated by the hydrofoil member 78 counteracts the wind force 102 in two respects. First, it develops a lateral force component 106 which counteracts the tendency of the wind vector 102 to produce broadside drift. Second, the force vector 104 provides a "righting moment" which acts about the center of buoyancy in a direction to oppose the tendency of the wind to cause the boat to heel over. Thus, it not only alleviates the tendency of the boat to yaw as it is traveling into the wind, but it better enables the sail assembly 64 to stand up to the wind and thus generate greater force from the wind to move the boat 60 through the water.

To analyze other facets of the present invention, it is believed to be helpful if the operating characteristics of the boat 60 of the present invention were compared to the previously discussed prior art boat 10 having a conventional keel arrangement.

First, with regard to the resistance of the water to the boat traveling therethrough, it was earlier indicated that in general there are four main components of friction resulting from a boat travelling through the water, namely, (a) frictional resistance, (b) wave making resistance, (c) eddy-making resistance, (d) induced drag.

With regard to frictional resistance, it is noted that the cross sectional configuration of the hull 62 is circular throughout. This circular configuration brings to a practical minimum the area of surface which is in contact with the water, relative to the displacement of the boat 60. Further, since the two keel members 66 are spaced from the hull, it is not necessary to add any extra faring surface which is required in the prior art boat 10 to blend the vertical surfaces of the keel 16 into the surface of the hull 12.

With regard to wave making resistance, since the hydrofoil members 78 exert a downward force component 108, this has something of the effect of adding ballast in that it tends to move the boat downwardly in the water so that more surface area of the hull 62 is in contact with the water. However, this is offset to some extent by the fact that as the boat 60 is lowered moderately in the water, the effective length of the boat in the water is increased. This in turn enables the boat to obtain a higher maximum speed with the same speed-length ratio.

With regard to eddy making resistance, it was previously indicated herein that the hydrofoil members 78 are arranged to substantially counterbalance the lateral force of the wind so that the boat 60 can travel at an angle to the wind with substantially no, or at the most very little, yaw angle. This is in contrast to the prior art boat 10 which encounters increased drag by creating more eddy currents by virtue of traveling at a yaw angle. Further, since the hydrofoil members 78 are totally submerged at a location spaced from the hull 62, any tendency for these members 78 to contribute to wave making is largely eliminated.

With regard to induced drag, as indicated previously herein, that is the total increase in resistance due to heel and yaw angle of the boat. First, with regard to heel angle, since the boat is in a substantially symmetrical circular pattern with respect to the longitudinal axis 74, even if the boat is heeled at a rather steep angle, substantially the same surface contours are presented to the water. Thus, there is substantially no, or at the most very little, increased resistance due to the boat being at a heel angle. Second, since the travel at the boat at a yaw angle is substantially eliminated, this source of drag is largely eliminated.

To turn our attention now to the functional aspects of the keel members 66 of the present invention incorporating the hydrofoil members 78, it was previously stated that a conventional prior art keel, such as the keel 16, has four purposes: namely (a) it effects the static ability of the boat by providing ballast at a lower location, (b) it produces most of the hydrofoil action needed to resist a lateral component of the wind force, (c) it influences the quality of the steering and handling of the boat, and (d) it supports the boat when on the ground.

With regard to the effect of the keel on static stability of the boat by providing ballast at a lower location, it will be noted that the large proportion of the mass of the keel members 66 of the present invention is concentrated in the two hydrofoil elements 78. Thus, this extra weight is added at the most desirable location without unnecessarily increasing the draft of the boat.

With regard to the function of the keel to resist the lateral component of wind force, it was noted in the prior discussion of the conventional prior art 16 that for this to occur in a boat of conventional design, such as the boat 10, the boat 10 must be first traveling at a yaw angle. On the contrary with the boat 60 of the present invention, the compensating lateral force component is developed by the two hydrofoil members 78 without any yaw angle of the boat 60. As indicated previously, this is due to the fact that the lateral force component 106 of the hydrofoil member 78 is generated by virtue of the fact that the boat 60 is in a heeled position and is traveling forwardly through the water.

With regard to the qualities of steering and handling of the boat, it was indicated previously in the discussion of the prior art that the difficulty of handling the boat when it is close hauled and traveling at a yaw angle arises from the fact that the center of lateral resistance of the boat moves generally forwardly when the prior art boat 10 of conventional design is traveling at a yaw angle. Since the travel of the boat 60 of the present invention at a yaw angle is largely eliminated, the problems of handling and steering the boat 60 of the present invention are greatly alleviated.

Finally, in the discussion of the prior art it was stated that the function of a keel was to support the boat 10 when it was on the ground. It becomes readily apparent from examining the construction of the two hydrofoil members 78 that these are well adapted to support the boat 60 from a ground location. Not only are the two keel members 66 spaced forward and aft of the center of gravity of the boat 60, but the broad lateral surface of the two hydrofoil members 78 provide a stable base. Thus the boat 60 will remain upright when standing on a beach at low tide, this being done either for recreational purposes or for maintenance of the boat.

In the discussion of the prior art, it was stated that the ability of the keel to develop a high "lift" force relative to drag was dependent on the aspect ratio of the keel. Relatively greater lift can be developed by making the spanwise axis of the keel (i.e. the axis perpendicular to the line of travel) long relative to its length or cordwise axis. In a keel 16 of convention design, where the spanwise axis is vertically oriented, the dimension of the spanwise axis is limited for two reasons. First if the keel is made rather deep, the draft of the boat becomes unnecessarily large. Second, increasing the depth of the keel 16 contributes adversely to the dynamic stability of the boat by causing the force developed by the keel to be exerted at a relatively low location to increase the moment arm about which the keel acts relative to the center of buoyancy of the boat 10. As indicated earlier, the force on the keel 16 tends to move the boat 10 even to a greater angle of heel. With the boat 60 of the present invention, since the two hydrofoil members 78 are horizontally aligned, the spanwise length of each hydrofoil member 78 can be increased without unnecessarily increasing the draft of the boat 60.

With regard to the dynamic stability of the boat 60, since the resultant force vector 104 developed by the two hydrofoil elements or members 78 is directed through the longitudinal axis 74 of the boat 60, any increase in the force developed by the two hydrofoil members 78 simply increases the righting moment which tends to counteract the tendency of the boat to heel over. (This was described in more detail previously herein with reference to FIG. 11.)

Figure 12:
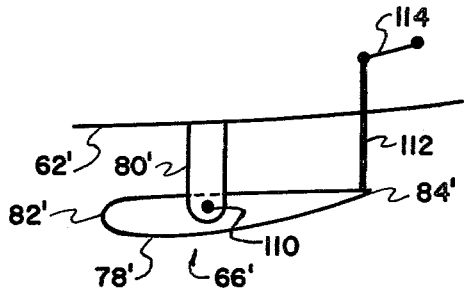
FIG. 12 is a semi-schematic view of a keel member of a second embodiment of the present invention.

A second embodiment of the present invention will now be described with reference to FIG. 12. Since the distinguishing features of this second embodiment are the manner in which the hydrofoil member 78 is mounted to its frame 80, the sail assembly 64 of the boat 60 is not shown in FIG. 12. Members of this second embodiment which are similar to the members of the first embodiment will be given like numerical designations, with a prime (') designation distinguishing those of the second embodiment.

As in the first embodiment, there are a pair of keel members 66', only one of which is shown for convenience of illustration. Each keel member 66' comprises a hydrofoil member 78' and a mounting frame 80'. However, instead of having the hydrofoil member 78' fixedly secured to the frame 80', each hydrofoil member 78' is mounted for limited rotation about a horizontal transversely extending longitudinal axis, indicated at 110. The pivot mounting at 110 is or may be of conventional design, and as shown herein, it is moderately forward of the leading edge 82'. At the trailing edge 84' of each hydrofoil member 78', there is an upwardly extending positioning rod 112 which reaches through a water tight opening in the hull 62'. Since such water tight openings are known in the prior art, the details of the same are not shown herein.

Each rod 112 is operated by suitable control means indicated schematically by a lever indicated at 114. In actual practice, of course, the positioning means for the rod 112 would quite likely be a more sophisticated linkage. Also, the operation of the actuating members 114 could be initiated from a single source.

The main function of the two positioning rods 112 is to vary the angle of attack of the two hydrofoil members 78'. In the situation where the boat 60' is traveling with the wind so that there is very little tendency to drift laterally, it may be desirable to lower the trailing edge 84' of each hydrofoil member 78 so as to change the angle of attack of these two hydrofoil members 78' to bring the overall drag created by the hydrofoil members 78' to a minimum. When the boat 60' is traveling at an angle to the wind, the positioning of the hydrofoil member 78' could be maintained to generate the proper lateral force component to substantially eliminate any yaw.

Figure 14:
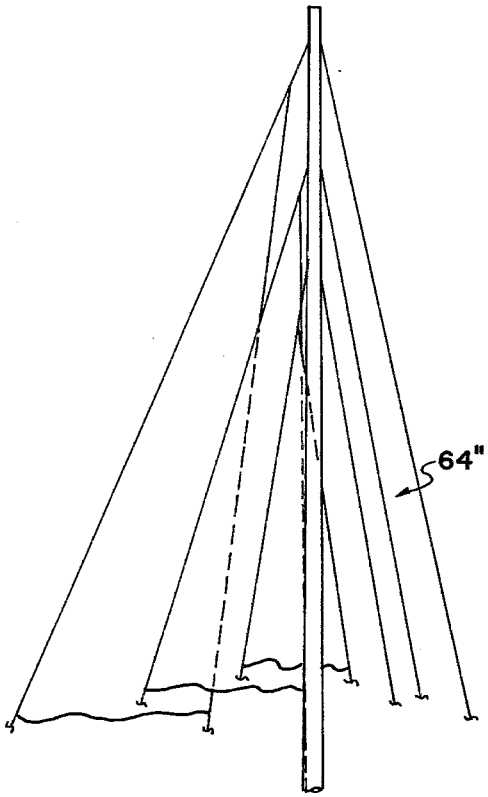
FIG. 14 is a top plan view of the boat of FIG. 13, this view being taken just above the base of the mast.
Figure 14:
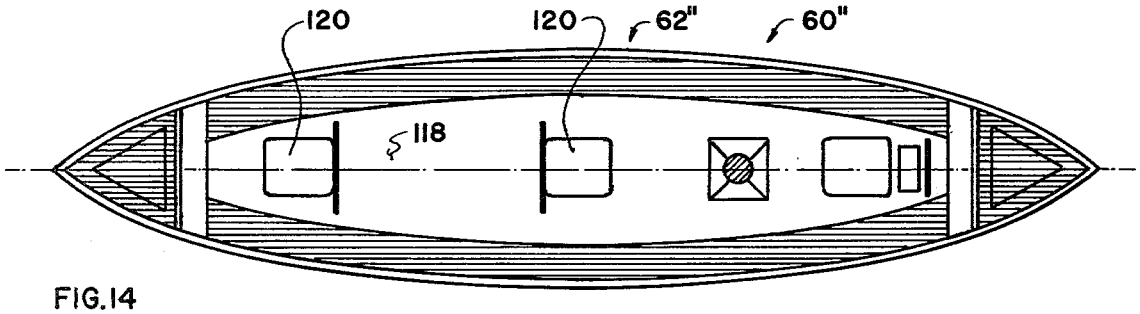
Figure 13:
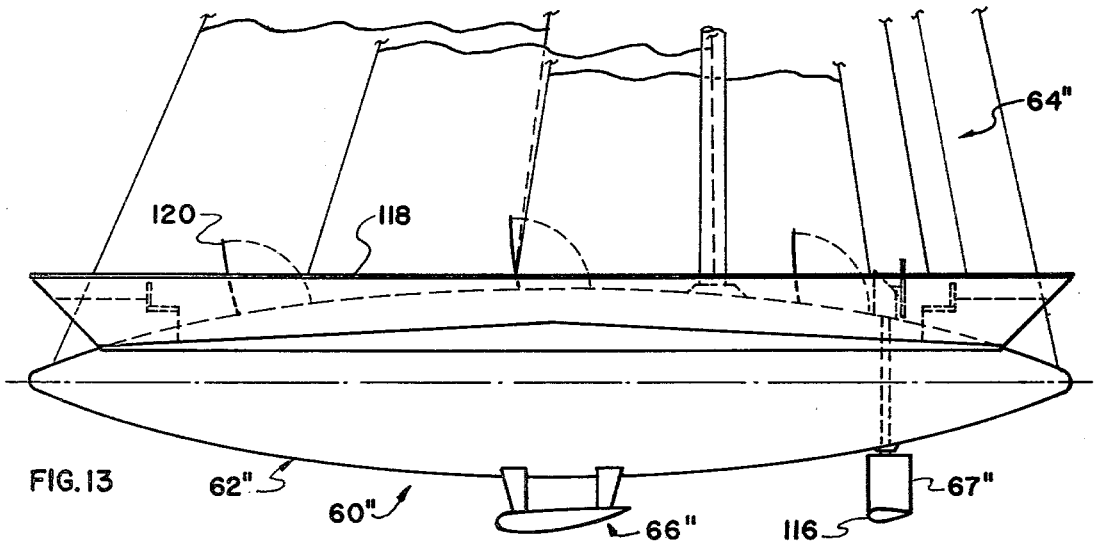
FIG. 13 is a side elevational view of yet a third embodiment of the present invention.

A third embodiment of the present invention is illustrated in FIGS. 13 and 14. In describing this third embodiment, components similar to those of the first embodiment will be given like numerical designations, with a double prime (") distinguishing those of the third embodiment.

As in the first embodiment, the boat 60" comprises a hull 62" and a sail assembly 64". However, instead of having two keel members, there is a single main keel member 66" centrally located with respect to both the longitudinal and transverse axes of the house 62". At the rear of the boat 60", there is a rudder 67", and at the lower edge of the rudder 67", there is a horizontally extending member 116 hydrodynamically contoured to minimize drag. When the boat 60" is being supported from a ground surface, this member 116 provides support at the aft end of the boat 60". In addition, this member 116 can be hydrodynamically contoured in such a manner as to enhance the operating characteristics of the boat 60" by producing a lift force.

The keel member 66" (and also the rear hydrodynamic member 116 if it is contoured to develop a vertical lift force) is so arranged that the resultant downward lift force passes substantially through the center of gravity of the boat 60". Thus it will be appreciated that the operating characteristics of the boat 60" are substantially the same as those of the boat 60 of the first embodiment. Therefore, these will not be described in detail herein.

Just above the upper side of the hull 62", there is provided a horizontal deck 118. Access into the hull 62" is provided by a series of upwardly pivoting doors 120. With this arrangement, the structural integrity provided by the circular cross-section of the hull 62" is maintained throughout the length of the hull, and yet the hull 62" is provided with a rather large flat deck surface for the convenience of the people sailing on the boat 62".

Figure 15:
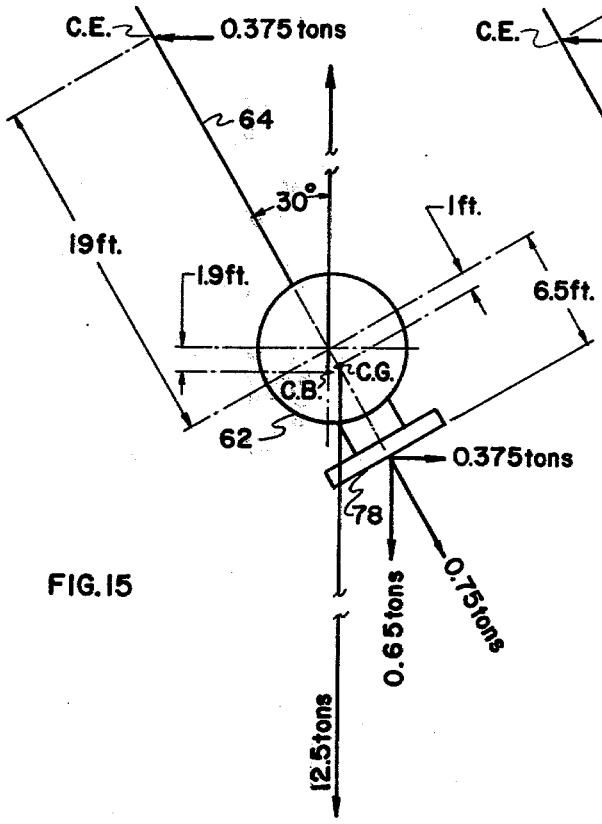
FIG. 15 is a semi-schematic view of a boat of a present invention, illustrating the nature and magnitude of the force components exerted on the boat of the present invention under certain assumed conditions.
Figure 16:
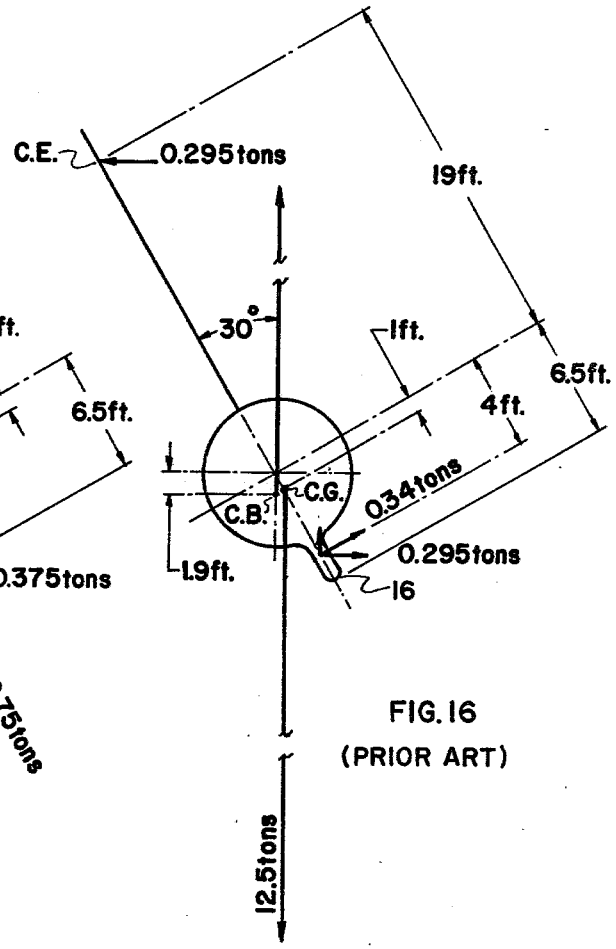
FIG. 16 (PRIOR ART)
FIG. 16 is a view similar to FIG. 15, illustrating a boat similar to that shown in FIG. 15, but having a conventional keel member and further illustrating the nature of magnitude of the force components exerted on this boat when it is in a heeled position.

To further analyze the operating characteristics of the present invention, reference is made to FIGS. 15 and 16. FIG. 15 is a rear semi-schematic view of the boat 60 of the present invention operating under the following assumed conditions:

a. The total displacement (i.e. weight) of the boat 60 is twelve and a half tons.

b. The center of gravity (C.G.) is one foot below the longitudinal center line of the hull 62 of the boat 60.

c. The center of bouyancy (C.B.) is 1.9 feet below the longitudinal center line of the hull 62.

d. The bottom side of the keel members 78 are 6.5 feet below the longitudinal center line of the hull 62.

e. The center of effort on the sail assembly 64 is 19 feet above the longitudinal center line of the hull 62.

f. The boat is heeled over at a 30° angle and is traveling at a speed of six knots.

g. The hydrofoil has a dimension of 6 feet by 7 feet (thus having a total surface area of 42 square feet) and is directed at a 2° downward angle of attack.

The righting moment generated by the weight of the boat acting about the lever arm which is the lateral distance between the center of gravity and the center of bouyancy is calculated according to the following:

$$\text{Sin } 30° \times 1.0 \text{ ft.} \times 12.5 \text{ tons} = 6.2 \text{ ton-ft.}$$

Thus there is a moment of 6.2 ton-feet tending to bring the boat back to its upright position.

As indicated previously herein, the force generated by the hydrofoil 78 also provides a righting moment. Previous computations indicated that with the particular hydrofoil specified in the assumptions noted above, and with a speed of six knots, the "lift" force generated by the hydrofoil members 78 perpendicular to its surface would be 0.75 tons. The righting moment provided by the hydrodynamic force generated by the keel members 78 would be computed according to the following formula:

$$\text{Sin } 30° \times 1.9 \text{ ft.} \times 0.75 \text{ tons} = 0.7 \text{ ton-ft.}$$

The sum of these two righting moments (i.e. 6.2 ton-feet and 0.7 ton-feet) total 6.9 ton-feet.

The capsizing moment generated by the wind against the sail is exerted at the center of effort of the sail assembly 64. This can be calculated according to the following formula, where 'X' equals the force of the wind against the sail assembly:

$$X = (6.9 \text{ ton-ft})/\cos 30°(19 \text{ ft.}) + 1.9 \text{ ft.}$$

Solving this equation indicates that 'X' (which is the lateral wind force component) equals 0.375 tons.

With reference to FIG. 16, similar calculations were made with regard to a similar boat, with the same assumptions as above, but with the boat being provided with a conventional keel arrangement. This keel was assumed to have a depth of 6.5 feet from the center line of the boat. Also it was assumed that the center of resistance of the keel was four feet below the longitudinal center line of the boat. Since the weight of the boat (i.e. 12.5 tons), the location of the center of gravity and the location of the center of bouyancy are at the same location as the boat shown in FIG. 15, the righting moment provided by the weight of the boat acting about the center of buoyancy remains at 6.2 ton-feet.

With regard to the force exerted by the keel 16 of the boat 10, calculations were made to determine the lateral force which could be generated by the keel 16, with this lateral force being adequate to balance the lateral force components generated by the wind against the sail, and yet being of a magnitude where the righting and capsizing moments of the boat would match. It was determined that if the keel of conventional design could generate a force normal to its surface of 0.34 tons, the force components and the moments would substantially balance out. With regard to the capsizing moment provided by the wind, this was calculated to be 5.4 ton-feet as follows:

$$\text{Cos } 30°(19 \text{ ft.} + 1.9 \text{ ft.})(0.295 \text{ tons}) = 5.4 \text{ ton-ft.}$$

With regard to the capsizing moment provided by the keel 16, this was calculated as follows:

$$[4 \text{ ft.} - \cos 30°(1.9 \text{ ft.})]0.34 \text{ tons} = 0.8 \text{ ton-ft.}$$

It can be seen that the two capsizing moments (i.e. 5.4 ton-feet and 0.8 ton-feet) make a total capsizing moment of 6.2 ton-feet. It can also be seen that this balances the righting moment of 6.2 ton-feet generated by the weight of the boat acting about the center of buoyancy.

The significance of the above calculations is that the boat with the prior art keel shown in FIG. 16 can withstand a lateral wind force of 0.295 tons and remain dynamically stable at a 30° heel. On the other hand, the boat of the present invention, illustrated in FIG. 15, can withstand a lateral wind force of 0.375 tons with the same 30° angle of heel. Thus, for two boats of comparable construction (the boat of the present invention shown in FIG. 15 and a comparable prior art boat shown in FIG. 16), the boat of the present invention can take 27% higher wind force against the sail. Proceeding on the assumption that the wind force is exerted at the same center of effort (C.E.) and with the same proportionate wind drag, the sail assembly would be able to generate 27% more force to propel the boat of the present invention through the water with the keel arrangement of the present invention.

The above calculations are intended to give a typical example of the operating characteristics of the boat of the present invention as compared to a comparable prior art boat. To demonstrate the operating characteristics of two such boats in a large variety of operating situations is obviously beyond the scope of this description of the preferred embodiments. However, the calculations presented above do illustrate certain operating advantages of the present invention in a rather typical situation for the operation of sailboats.

What is claimed is:

1. A sailboat comprising:

a. a displacement hull having front and rear ends, a longitudinal axis, a transverse horizontal axis and a vertical axis, b. a sail assembly mounted to said hull and arranged to be able to be positioned relative to wind which is blowing at an angle to the longitudinal axis of the hull so that the sail develops an aerodynamic force within a predetermined force range, said aerodynamic force having a lateral aerodynamic force component and a forward aerodynamic force component, c. a keel member mounted beneath said hull, said keel member having a cordwise axis generally aligned with said longitudinal axis and a spanwise axis generally aligned with said transverse horizontal axis, d. said keel member being hydrodynamically contoured so that with the boat moving forwardly through water, said keel member produces a downward hydrodynamically created force having a substantial force component generally aligned with said vertical axis, and tending to increase the effective displacement of said hull, e. said keel member being positioned, sized and contoured relative to said sail assembly, so that with said boat in a heeled position and travelling forwardly with a small yaw angle, said keel member develops a downwardly and laterally direct keel force with both vertical and lateral keel force components, said keel force being of a magnitude that the lateral keel force component substantially counteracts the lateral aerodynamic force component, whereby with said boat travelling with its longitudinal axis at an angle to the wind, said keel member is able to generate its hydrodynamic force simply by virtue of forward movement of the boat, without necessity of the boat travelling at a substantial yaw angle, with the result that the hydrodynamic lateral force component is able to substantially counteract the lateral aerodynamic force component in a manner to substantially diminish yaw angle in the forward travel of the boat.

2. The boat as recited in claim 1, wherein said boat has a center of gravity and said keel member is so positioned that the keel force developed by the keel member is generally aligned with said center of gravity, so that with the boat in a heeled position said keel force develops a righting moment which tends to counteract at least partially a capsizing moment developed by the lateral aerodynamic force component.

3. The boat as recited in claim 2, wherein said keel member comprises at least one main hydrofoil member positioned beneath said hull and spaced downwardly therefrom at a general location directly beneath said center of gravity.

4. The boat as recited in claim 2, wherein said keel member comprises a plurality of hydrofoil members positioned beneath said hull and spaced downwardly therefrom, said hydrofoil members being spaced longitudinally from one another along said hull.

5. The apparatus as recited in any one of claims 1, 2, 3 or 4, wherein there is adjustable mounting means for said keel member to permit angle of attack of the keel member to be changed to generate greater of less downward keel force.

6. The boat as recited in claim 1, wherein said hull has an upper portion and a lower portion adapted to engage water upon which the boat is floating, at least the lower hull portion having a convexly curved generally circular transverse cross-sectional configuration, with the hull tapering to a narrower cross-sectional configuration in both a forward and rear direction from a center portion of said hull, said hydrofoil member being spaced downwardly from said hull so that water passes between said hull and said keel member.

7. In a sail boat comprising a displacement hull having front and rear ends, a longitudinal axis, a transverse horizontal axis and a vertical axis, said boat further comprising a sail assembly mounted to said hull and arranged to be able to be positioned relative to wind which is blowing against the boat at an angle to the longitudinal axis so that said sail develops an aerodynamic force within a predetermined force range, with said aerodynamic force having a lateral aerodynamic force component and a forward aerodynamic force component, a method of operating said sailboat in a manner to counteract said lateral aerodynamic force component and thus minimize yaw angle when said boat is travelling at an angle to the wind, said method comprising:

providing a keel member beneath said hull, with said keel member having a cordwise axis generally aligned with the longitudinal axis and extending transversely beneath said hull, said keel member having a forward leading edge and a rear trailing edge and being hydrodynamically contoured so that with the boat moving forwardly through the water, at a small yaw angle, said keel member produces a downwardly directed hydrodynamically created force component, tending to increase the effective displacement of said hull, utilizing the keel member to provide a downward hydrodynamic force having a substantial force component generally aligned with said vertical axis, with said keel member being positioned, sized and contoured relative to the sail assembly, so that with the boat in a heeled position, the keel member develops a downwardly and laterally directed keel force with both vertical and lateral keel force components of such a magnitude that the lateral keel force component substantially counteracts the lateral aerodynamic force component.

8. The method as recited in claim 7, wherein said boat has a center of gravity, said method further comprising positioning said keel member so that said hydrodynamic force component is generally aligned with said center of gravity, so that said keel force develops a righting moment to counteract a capsizing moment generated by the wind.

9. The method as recited in claim 8, wherein said keel member is provided in the form of one main hydrofoil member positioned beneath said hull and spaced downwardly therefrom.

10. The method as recited in claim 8, wherein said keel member is provided in the form of a plurality of hydrofoil members at longitudinally spaced locations and spaced downwardly from said hull.

11. The method as recited in any one of claims 7, 8, 9 and 10, further comprising adjusting said keel member angularly in a manner to change its angle to attack to generate a keel force of a proper magnitude to properly counteract said aerodynamic lateral force component.

12. A sailboat comprising:

a. a displacement hull having front and rear ends, a longitudinal axis, a transverse horizontal axis and a vertical axis, b. a sail assembly mounted to said hull and arranged to be able to be positioned relative to wind which is blowing at an angle to the longitudinal axis of the hull so that the sail develops an aerodynamic force within a predetermined force range, said aerodynamic force having a lateral aerodynamic force component and a forward aero-dynamic force component, c. a keel member mounted beneath said hull, said keel member having a cordwise axis generally aligned with said lonitudinal axis and extending transversely beneath said hull, d. said keel member being hydrodynamically contoured so that with the boat moving forwardly through water, said keel member produces a downward hydrodynamically created force having a substantial force component generally aligned with said vertical axis, and tending to increase the effective displacement of said hull, e. said keel member being positioned, sized and contoured relative to said sail assembly, so that with said boat in a heeled position and travelling forwardly with a small yaw angle, said keel member develops a downwardly and laterally directed keel force with both vertical and lateral keel force components, said keel force being of a magnitude that the lateral keel force component substantially counteracts the lateral aerodynamic force component, whereby with said boat travelling with its longitudinal axis at an angle to the wind, said keel member is able to generate its hydrodynamic force simply by virtue of forward movement of the boat without necessity of the boat travelling at a yaw angle, with the result that the hydrodynamic lateral force component is able to substantially counteract the lateral aerodynamic force component in a manner to substantially diminish yaw angle in the forward travel of the boat.

13. The boat as recited in claim 12, wherein said boat has a center of gravity and said keel member is so positioned that the keel force developed by the keel member is generally aligned with said center of gravity, so that with the boat in a heeled position said keel force develops a righting moment which tends to counteract at least partially a capsizing moment developed by the lateral aerodynamic force component.

14. The boat as recited in claim 13, wherein said keel member comprises at least one main hydrofoil member positioned beneath said hull and spaced downwardly therefrom at a general location directly beneath said center of gravity.

15. The boat as recited in claim 13, wherein said keel member comprises a plurality of hydrofoil members positioned beneath said hull and spaced downwardly therefrom, said hydrofoil members being spaced longitudinally from one another along said hull.

16. The apparatus as recited in any one of claims 12, 13, 14 or 15, wherein there is adjustable mounting means for said keel member to permit angle of attack of the keel member to be changed to generate greater of less downward keel force.

17. The boat as recited in claim 12, wherein said hull has an upper portion and a lower portion adapted to engage water upon which the boat is floating, at least the lower hull portion having a convexly curved generally circular transverse cross-sectional configuration, with the hull tapering to a narrower cross-sectional configuration in both a forward and rear direction from a center portion of said hull, said hydrofoil member bein spaced downwardly from said hull so that water passes between said hull and said keel member.

* * * * *